US006789342B2

(12) United States Patent
Wonisch et al.

(10) Patent No.: US 6,789,342 B2
(45) Date of Patent: Sep. 14, 2004

(54) FIREARM

(75) Inventors: Franz Wonisch, Arnsberg (DE); Wulf H. Pflaumer, Arnsberg (DE); Thomas Scheunert, Arnsberg (DE)

(73) Assignee: Umarex Sportwaffen GmbH & Co., KG, Arnsberg (DE)

( * ) Notice: Subject to any disclaimer, the term of this patent is extended or adjusted under 35 U.S.C. 154(b) by 0 days.

(21) Appl. No.: 10/066,566

(22) Filed: Feb. 6, 2002

(65) Prior Publication Data

US 2002/0116857 A1 Aug. 29, 2002

(30) Foreign Application Priority Data

Feb. 23, 2001 (DE) ..... 101 08 710

(51) Int. Cl.[7] ..... F41A 21/00
(52) U.S. Cl. ..... 42/75.02; 42/70.02; 42/77
(58) Field of Search ..... 42/75.02, 77, 70.02; 89/29

(56) References Cited

U.S. PATENT DOCUMENTS

| | | | | | |
|---|---|---|---|---|---|
| 1,027,891 | A | | 5/1912 | Peck, Jr. et al. | |
| 1,291,688 | A | * | 1/1919 | Rosebush | 89/141 |
| 1,320,578 | A | * | 11/1919 | Savage | 89/145 |
| 1,459,285 | A | * | 6/1923 | Declaye | 89/150 |
| 2,115,041 | A | * | 4/1938 | Obregon | 89/138 |
| 2,945,316 | A | | 7/1960 | Mulno | |
| 3,208,178 | A | * | 9/1965 | Seiderman | 42/71.01 |
| 3,755,958 | A | * | 9/1973 | Heinicke | 42/17 |
| 3,776,096 | A | * | 12/1973 | Donovan | 89/174 |
| 4,409,882 | A | * | 10/1983 | Blackshaw et al. | 89/163 |
| 5,115,589 | A | | 5/1992 | Shuker | |
| 5,388,362 | A | | 2/1995 | Melcher | |
| 5,669,169 | A | | 9/1997 | Schmitter et al. | |
| 6,513,274 | B1 | * | 2/2003 | Vastag | 42/77 |
| 6,519,887 | B1 | * | 2/2003 | Allen et al. | 42/70.02 |

FOREIGN PATENT DOCUMENTS

| | | |
|---|---|---|
| AT | 71772 | 5/1916 |
| CH | 648 652 | 3/1985 |
| DE | 333248 | 2/1921 |
| DE | 371852 | 3/1923 |
| DE | 384357 | 11/1923 |
| DE | 393616 | 4/1924 |
| DE | 1 428 770 | 5/1963 |
| DE | 8 28 910 | 7/1981 |
| DE | 32 03 991 | 8/1983 |
| DE | 32 39 093 | 4/1984 |
| DE | 35 22 155 | 1/1986 |
| DE | 38 18 838 | 12/1989 |
| DE | 40 16 669 | 11/1991 |
| DE | 42 20 922 | 1/1994 |
| EP | 1 058 081 | 12/2000 |

* cited by examiner

*Primary Examiner*—Michael J. Carone
*Assistant Examiner*—M. Thomson
(74) *Attorney, Agent, or Firm*—Hoffman, Wasson & Gitler, PC

(57) ABSTRACT

A fire arm, especially a small caliber pistol, having a grip, a frame connected to the grip, a barrel unit fixed on the frame in the operating state of the fire arm, with a barrel tube and a bolt which can move relative to the frame and barrel unit such that when a shot is fired it can move to the rear against the direction of firing, the barrel unit and/or the frame having fastening means which allow detachable mounting of the barrel unit on the frame.

20 Claims, 13 Drawing Sheets

FIREARM

BACKGROUND OF THE INVENTION

This invention relates to a fire arm, especially a small caliber pistol, having a grip, a frame connected to it, a barrel unit fixed on the frame in the operating state of the fire arm, with a barrel tube and a bolt which can move relative to the frame and barrel unit, such that when a shot is fired it can move to the rear against the direction of firing.

Fire arms of this type have been known for a long time. In contrast to large-caliber fire arms, in which there is a locking means which joins the barrel and the bolt to one another, in small caliber pistols, generally, the barrel or barrel unit is fixed on the frame. Large caliber firearms are therefore not encompassed by the aforementioned generic concept, because in them, the barrel sits loosely in the locking unit so that when a shot is fired, first the barrel and bolt, driven by the recoil of the fired round, traverse a common return path until the bolt separates from the barrel and subsequently continues its further return path alone. In a large-caliber firearm, which is generally made in this way with a locking means, it is possible to replace the barrel tube or barrel unit by another version of the barrel tube. Firearms with these locking means for the barrel or barrel unit are, however, generally very complex and therefore comparatively expensive to produce.

There is no possibility of changing the barrel in small caliber pistols, which are generally equipped with a spring-mass bolt. In these firearms, according to the generic concept, the barrel unit is fixed on the frame and is permanently attached. It is permanently attached by fixed injection, or by pinning the barrel tube to the corresponding frame parts. It therefore is desirable, in small caliber pistols, i.e. in firearms in which the barrel tube, or barrel unit, is to be fixed or fixable on the frame, to be provided with the possibility of changing without in doing so, the need to choose a costly design, such as that of choosing a locking mechanism.

The object of this invention is therefore to devise a firearm, of the initially mentioned type, which can be economically produced and which enables the barrel to be changed.

SUMMARY OF THE INVENTION

Provided is a barrel unit, and/or a frame, which includes fastening means which allow detachable mounting of the barrel unit on the frame. In contrast to the existing structures, the barrel unit is not permanently and, at least for the user, undetachably joined to the frame, but is detachably mounted on the frame via fastening means.

According to one preferred embodiment of this invention, the barrel unit has a barrel block, which is mounted permanently on the end of the barrel tube which is the back end in the direction of firing. The barrel block is mounted together with the barrel tube on the frame, or can be detached together with the barrel tube from the frame in order to change the barrel unit. In doing so, on the barrel block there can be a rise for inserting a round into the barrel tube and/or an extractor groove for pulling out an empty shell casing. By providing a barrel block which is made in this way, when changing and subsequently attaching the barrel unit to the frame, problems with respect to accurate adjustment of the rise and the extractor groove relative to the barrel tube are prevented.

Advantageously, on the bottom of the barrel block a guide rib is attached which fits into a guide groove which interacts with it on the frame when the barrel unit is mounted on the frame. The guide groove and the guide rib by their interaction ensures reliable positioning of the barrel unit on the frame. Furthermore, the interaction of the guide rib and the guide groove result in the inability of the barrel tube to turn in the frame.

According to one preferred embodiment of this invention, the fastening means can include a frame bridge which is attached to the frame and which has a through hole through which the barrel tube extends when the barrel unit is mounted on the frame.

Furthermore, the fastening means can include screw means, which when joined to one another enable the barrel unit to be fixed on the frame. Screw means represent a detachable attachment method which is also easy to manage for the user.

Preferably the screw means has a barrel nut encompassed by the barrel unit and an outside thread in the end area of the barrel tube which is the front area in the direction of firing, and by screwing the barrel nut onto the outside thread of the barrel tube the barrel unit can be fixed on the frame bridge. To do this, the barrel unit also has a barrel jacket which can be slipped from the front onto the barrel tube such that with its front end it can adjoin the barrel nut and that at the same time the barrel nut can be screwed onto the outside thread of the barrel tube. Here, when the barrel unit is mounted on the frame the barrel jacket from forward fits on or in the frame bridge, conversely the barrel block from the back fits on or in the frame bridge so that when the barrel nut is tightened the barrel jacket, or the barrel block, is pressed from the front or back against the corresponding contact surfaces of the frame bridge so that in this way the barrel unit is securely fixed against the frame. The barrel unit thus acts as a counter bearing when the barrel tube or the barrel jacket is screwed onto the frame bridge. Exact axial positioning of the barrel tube on the frame is thus ensured.

The firearm includes a magazine safety which allows a shot to be fired only when the magazine has been inserted into the firearm. When the magazine is not inserted the magazine safety, which is pivotally supported on the frame being pressed by a spring against a connecting rod which can functionally connect the trigger to a sear which is dynamically joined to the hammer, and the connecting rod in the state pressed down, a round cannot be fired. Conversely, when the magazine is inserted, the magazine safety is pressed upward against the force of the spring so that the connecting rod likewise moves up into a position such that by actuating the trigger, a shot can be fired. One such magazine safety means represents an economical alterative to the magazine safety means known in the art.

The firearm includes a trigger lock that can be transferred out of the position in which the trigger can be actuated, into the position in which the trigger cannot be actuated. The trigger lock has an engagement surface which is made as a roof-like surface, and this engagement surface can be reached through an opening in the grip from the outside, a wrench being provided which has an opposing contour which corresponds to the engagement surface. One such trigger lock, in contrast to the trigger locks known from the art, can be more economically implemented.

The firearm has a rear sight which can be transversely adjusted and which by means of a rear sight mounting is attached on the rear top of the bolt. The rear sight mounting has an internal thread which extends in the transverse direction and the rear sight has a through hole which extends in the transverse direction, and after placing the rear sight on the rear sight mounting such that the hole of the rear sight is flush with the internal thread of the rear sight mounting, a setscrew can be inserted through the hole of the rear sight into the internal thread of the rear sight mounting such that by turning the setscrew the rear sight can be adjusted relative to the bolt in the transverse direction. In contrast to the adjustable rear sights which are known from the art, the rear sight as depicted in the invention is made very simple and economical.

The firearm, in the rear area of the bolt, has a roller safety with safety fins which are attached on the outer sides to it and which can be transferred by catching from the safety-on into the safety-off position of the roller safety. The safety fins being produced from a flexible material, especially from plastic. The locking in the two end positions being achieved by catch cams, especially in the form of balls, which are mounted accordingly on the safety fins or on the bolt in the area of the end positions. In the existing art, the aforementioned balls must be held elaborately by means of springs in order to reliably ensure locking in the end positions. In the safety fins as described in the invention, due to the flexibility of the plastic used, it is ensured that the two safety fins can also catch in the end positions even without complex spring holding of the balls.

The firearm has an breech block which is housed in the bolt and which is made of steel. Conversely, the bolt is made from a zinc diecasting, an aluminum, a plastic or a similar light and economical material. By using the aforementioned economical materials the production costs of the firearm can be reduced.

The bolt is made from a zinc casting, an aluminum, a plastic or a similar light and economical material. Into the side wall of the bolt, a steel cylinder pin is inserted and is used as wear protection for a slide catch lever. Here, the production costs of the firearm can be reduced by choosing economical materials.

The frame is made from a zinc diecasting, an aluminum, a plastic or a similar light and economical material. The cylinder pin which interacts with the connecting rod and which is located on the frame is made of steel.

In the bolt, there is a breech block on which a swivelling loaded state indicator is mounted. This can be viewed, or touched, from the outside and it indicates to the user, when there is a round in the barrel, that the firearm is loaded. The loaded state indicator shows when the firearm is loaded, when one section adjoining the rear edge of the cartridge. This loaded state indicator, compared to the loaded state indicators known from the past, can also be produced much more economically. Furthermore, the loaded state indicator can be produced from plastic so that it is possible for the loaded state indicator to safely adjoin the rear edge of the cartridge.

The firearm includes a dismounting clip which is movably held on the frame and in the upper position releases the bolt on the frame to be able to move and in the lower position releases the bolt for removal, the dismounting clip being made of an at least partially elastic material, especially of plastic. The dismounting clip is also used as an end stop for the corresponding contact surface of the bolt when the bolt moves to the rear when a round is fired. Based on the double function of the dismounting clip, a buffer effect is achieved in firearms without the need for extra parts.

BRIEF DESCRIPTION OF THE DRAWINGS

Other features and advantages of this invention become clear using the following description of preferred embodiments with reference to the attached figures.

DETAILED DESCRIPTION OF THE INVENTION

Figure 1:
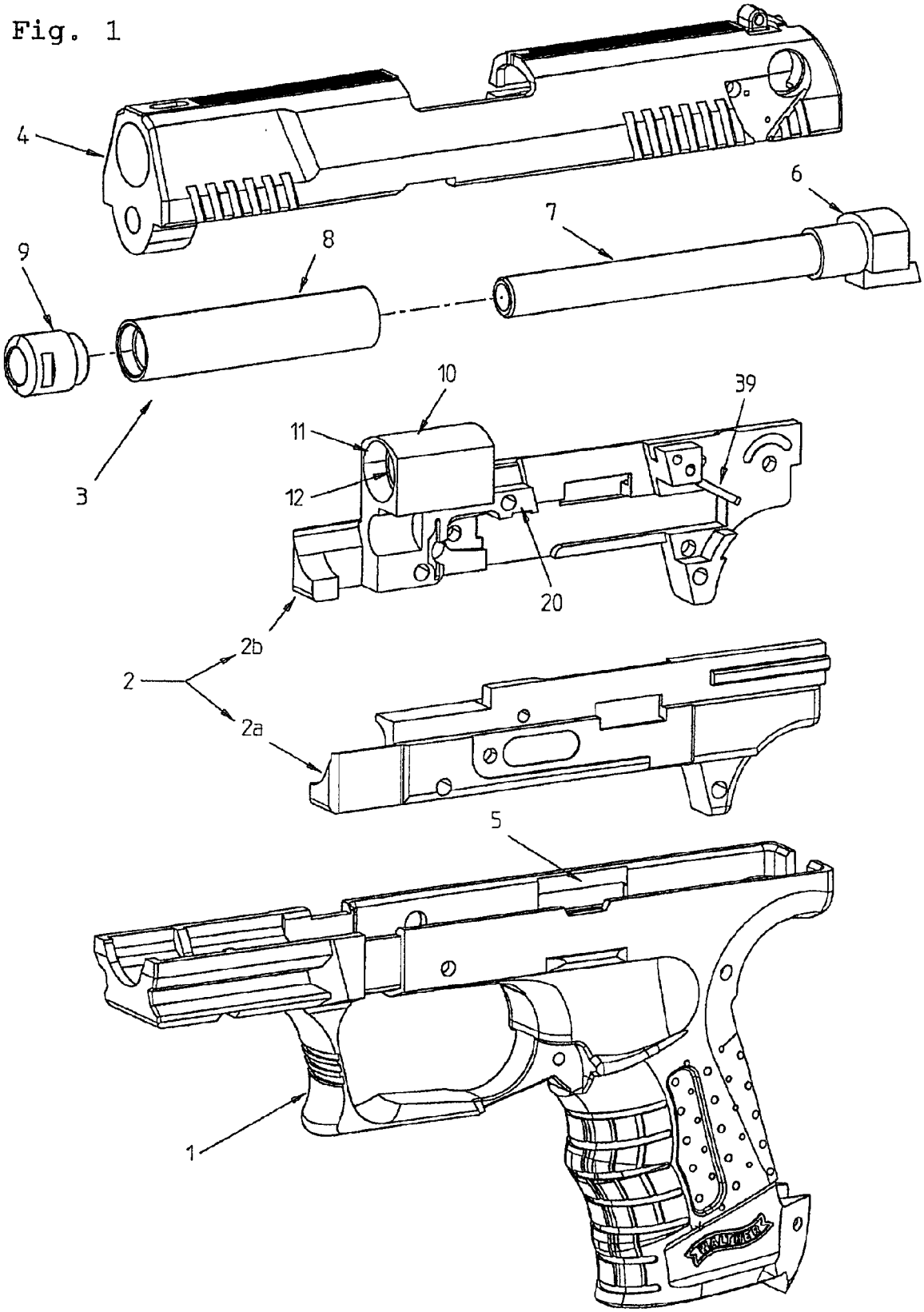
FIG. 1 shows a exploded view of parts of the firearm as claimed in the invention which ensures the barrel changing possibility in interaction.

FIG. 1 shows that a firearm, which is made as a small caliber pistol, and includes a grip 1, a frame 2, a barrel unit 3 and a bolt 4. The grip 1 on its top has a recess 5 opened to the top for accommodating the frame 2. The frame 2 in the embodiment shown, has two parts 2*a*, 2*b* which can be connected to one another. The barrel unit 3 in the embodiment shown, has a barrel block 6, a barrel tube 7, a barrel jacket 8 and a barrel nut 9. In the embodiment shown, the barrel block 6 is securely joined to the barrel tube 7.

On the frame part of the two frame parts 2*b* which is the right-hand one in the direction of firing, the frame bridge 10 is molded onto its upper side and has a hole 11 which is a through hole in the direction of firing for accommodating the barrel tube 7, or the barrel jacket 8. The inside diameter of the hole 11, on the side of the frame bridge, which is the front side in the direction of firing, is chosen such that the barrel jacket can be inserted to fit. At a distance within the hole 11, there is a projection 12 which is used as a stop for the barrel jacket 8, which is to be inserted from the front into the hole 11.

Figure 5:
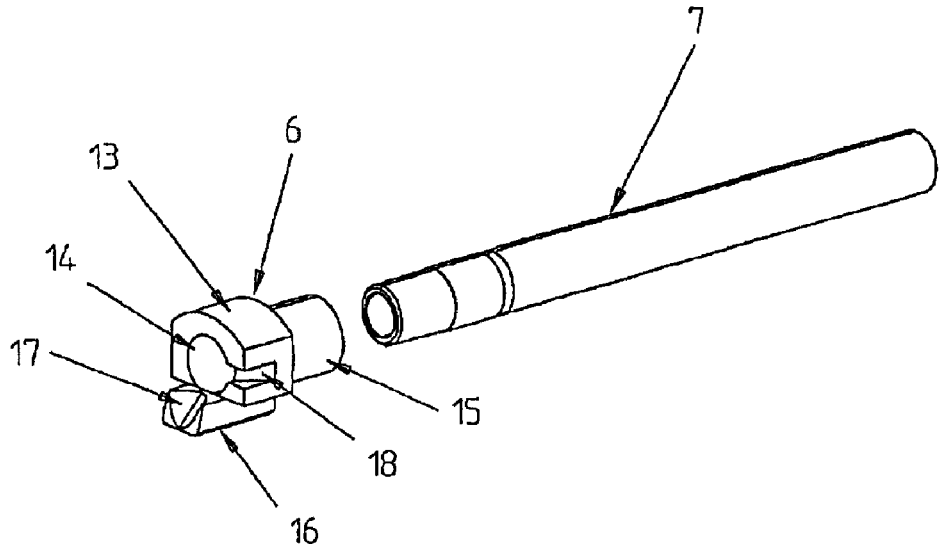
FIG. 5 shows a perspective view of a barrel block as claimed in the invention with a barrel tube as claimed in the invention.

The barrel block 6 and the barrel tube 7 are detailed in FIG. 5. The barrel block 6 includes an essentially cuboidal body 13 with a hole 14 which passes through it in the direction of firing for accommodating the barrel tube 7. In the firing direction, a connecting sleeve 15 is molded on the body 13 and its inside diameter corresponds essentially to the outside diameter of the end of the barrel tube 7 facing the barrel block 6 so that the barrel tube 7 can be soldered securely to the connecting sleeve 15 of the barrel block 6.

On the bottom of the barrel block, there is a guide rib 16 which extends in the direction of firing and which is used for fitted installation of the barrel unit 3 in the frame 2, as is detailed below. On the end of the guide rib 16, facing away from the barrel tube 7, there is an ascent 17 for inserting a round into the barrel tube 7. Furthermore, on one of the two sides of the barrel 13, there is an extractor groove 18 for removing the empty casing.

Figure 15:
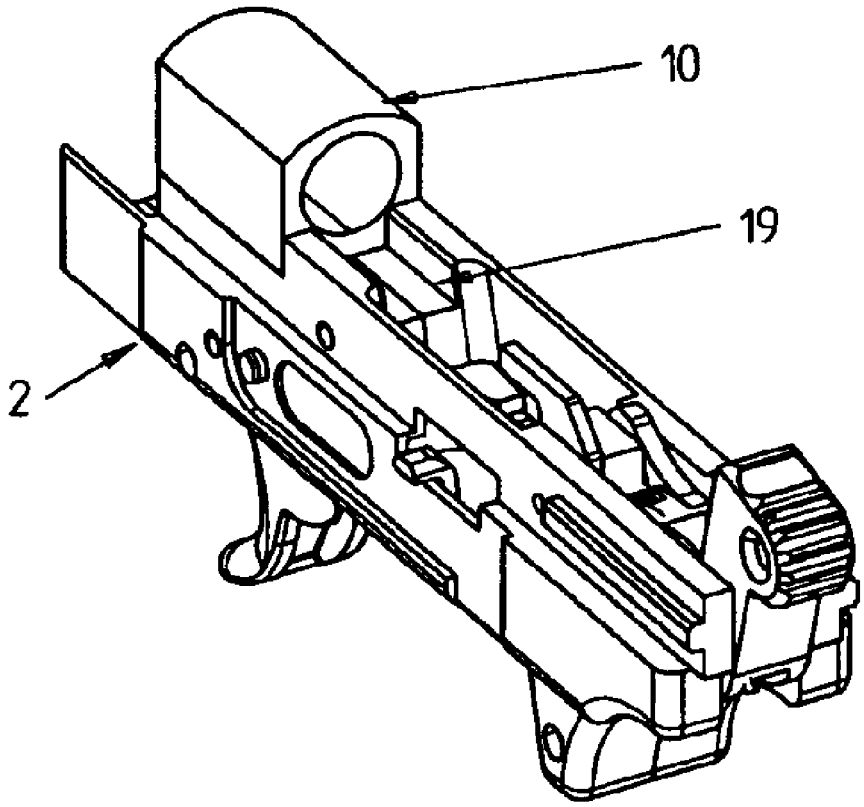
FIG. 15 is a detailed view of the guide groove on the frame leading to the frame bridge.

On the frame 2, after its assembly, there is a guide groove 19, of which in FIG. 1 the lateral boundary 20 formed by the right-hand frame part 2*b* is apparent. The guide groove is used when the barrel tube 7 is placed from the rear into the hole 11 of the frame bridge 10 for lateral fixing of the barrel block 6 by accommodating the guide rib 16 mounted on the bottom of the barrel block 6. A detailed view of the guide groove is shown in FIG. 15.

Figure 2:
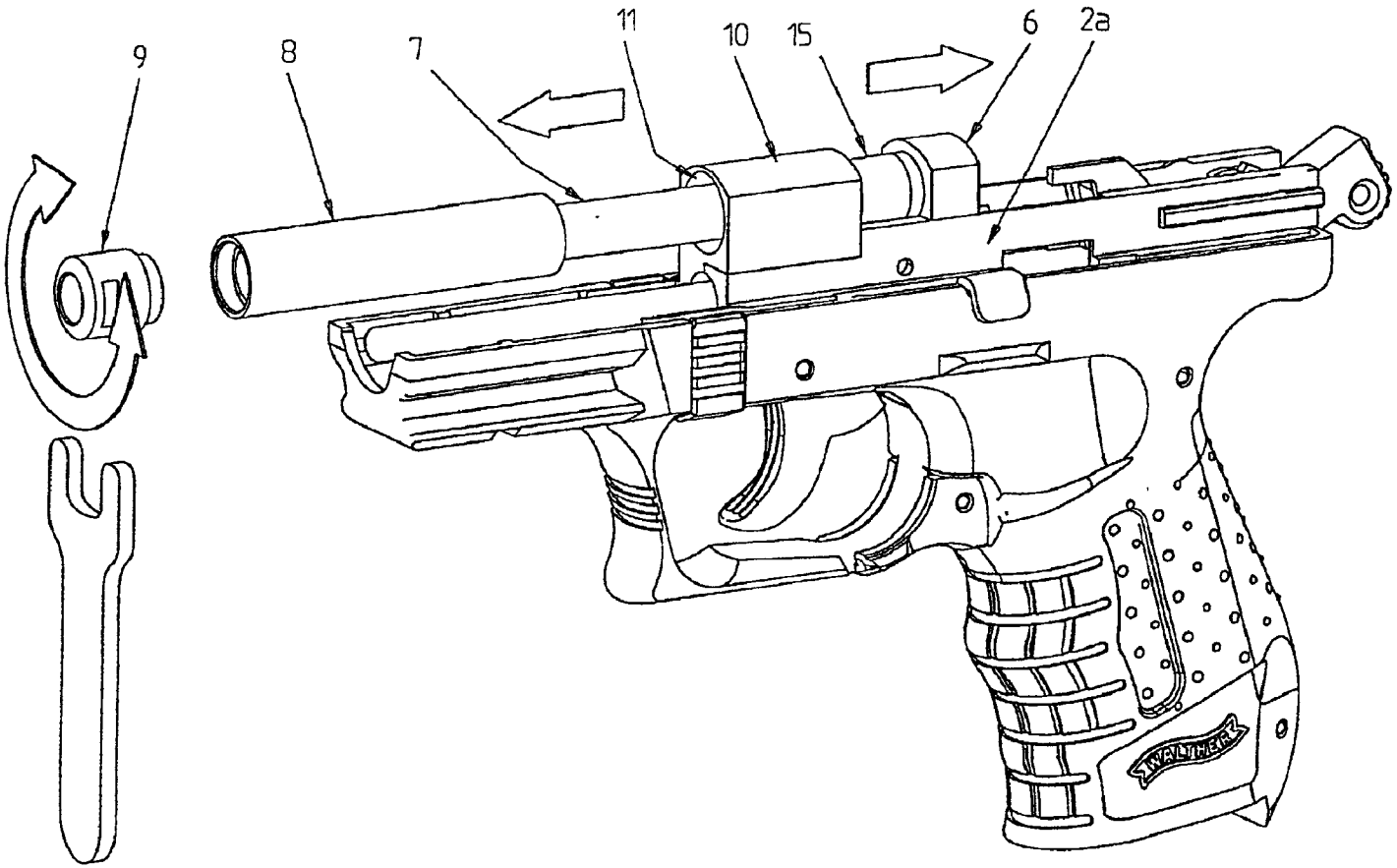
FIG. 2 shows a perspective view of the firearm as claimed in the invention with the bolt removed during installation of the barrel unit.

FIG. 2 shows the barrel tube 7 with the barrel block 6 being placed in the hole 11 of the frame bridge 10. In particular, the end of the hole 11 facing the barrel block 6 in the frame bridge 10 has an inside diameter such that the connecting sleeve 15 of the barrel block 6 can be inserted to fit into this section of the hole 11. After inserting the connecting sleeve 15 into the hole 11, as far as the body 13 of the barrel block 6 on the back end of the frame bridge 10, the barrel jacket 8 is slipped onto the barrel tube 7 from the front until its back end adjoins the projection 12 of the hole 11. Then, the internally threaded barrel nut 9 is screwed onto the front end of the barrel tube 7, which has an outside thread (not shown) which matches the inside thread of the barrel nut 9. By tightening the barrel nut 9, the front end of the body 13 is pressed against the back end of the frame bridge 10 and, at the same time, the back end of the barrel jacket 8 is pressed against the projection 12. This yields a secure seat of the barrel unit 3 on the frame 2.

The barrel unit 3 can be changed by loosening the barrel nut 9 and pulling the barrel jacket 8 or the barrel tube 7 out of the frame bridge 10 and by corresponding insertion and fixation of another, for example, longer barrel tube and a correspondingly, likewise, longer barrel jacket.

Figure 6A:
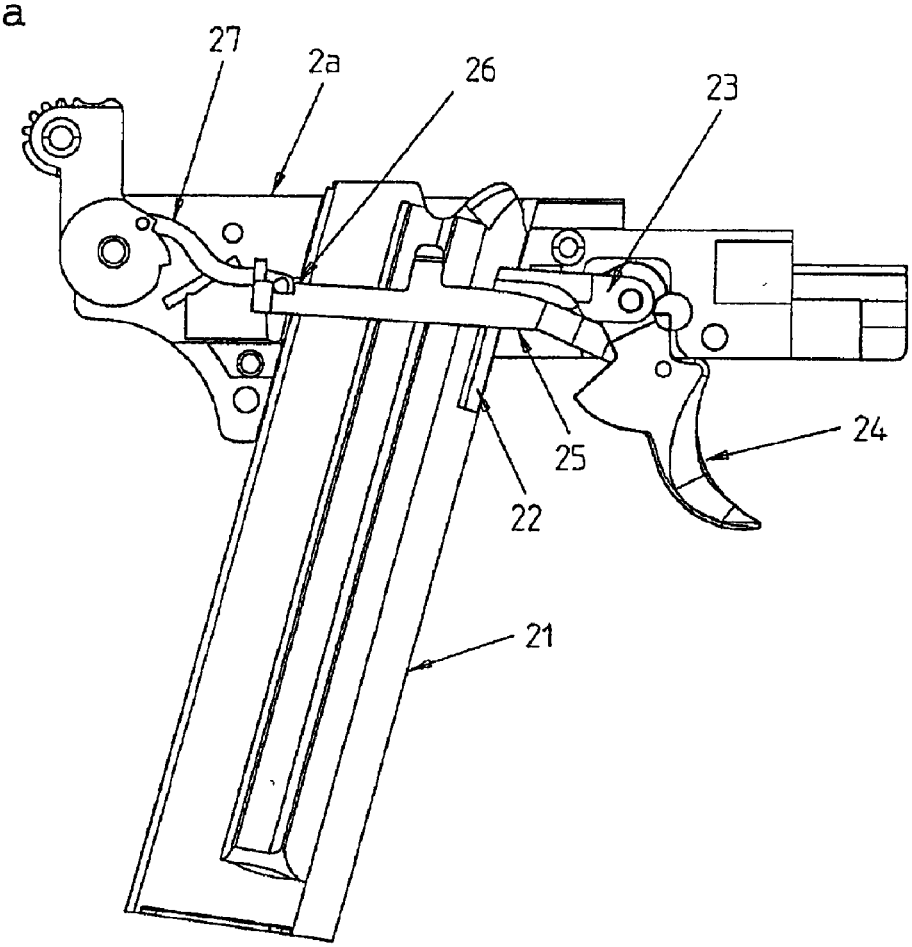
FIG. 6*a* shows a detailed schematic of the parts of the firearm as claimed in the invention which contribute to the magazine safety, in the safety-off position.
Figure 6B:
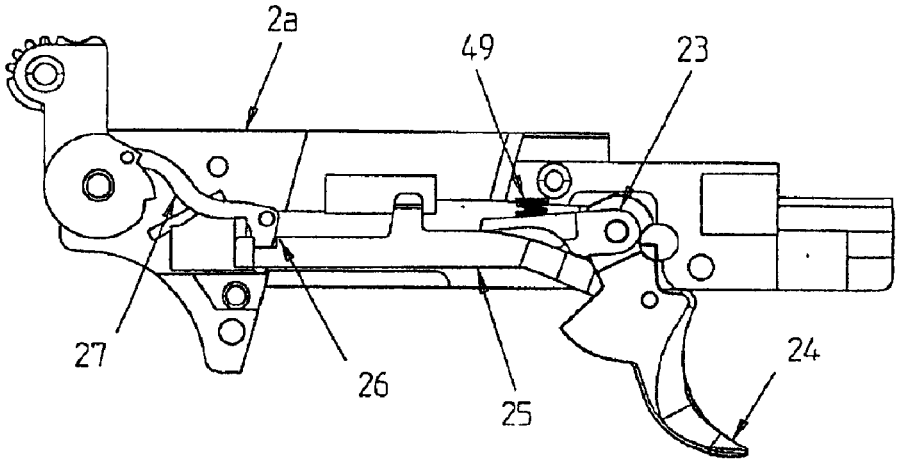
FIG. 6*b* shows a view according to FIG. 6*a* without the magazine in the safety-on position.

FIGS. 6*a* and 6*b* show a magazine safety means. FIG. 6*a* shows the magazine safety means in the safety-off position, this safety-off position being achieved by inserting the magazine tube 21 into the firearm. The magazine tube 21, on its top end, on the outside, has a projection 22 which can press below a magazine safety 23 which can be swivelled around a horizontal axis. FIG. 6*a* shows the magazine safety in its position pressed upward. In this position, the connecting rod 25, which can be actuated by the trigger 24, can be pushed to the left, in FIG. 6*a*, such that a projection 26, located on the top of the connecting rod 25, can engage a sear 27, at the top, such that by actuating the trigger 24 a round can be fired.

Between the top of the magazine safety 23, and a corresponding projection on the left frame part 2*a*, or the right frame part which is not shown, there is a spring 49 by which the magazine safety 23 is pretensioned down. After removing the magazine tube 21, the spring 49 presses the magazine safety 23 down, likewise, the connecting rod 25 being pushed down by the magazine safety 23. This motion of the connecting rod 25 down, which is apparent from FIG. 6*b*, ensures that when the trigger 24 is actuated, the projection 26 of the connecting rod 25 cannot engage the sear 27, so that by actuating the trigger 24, a round cannot be fired.

Figure 7:
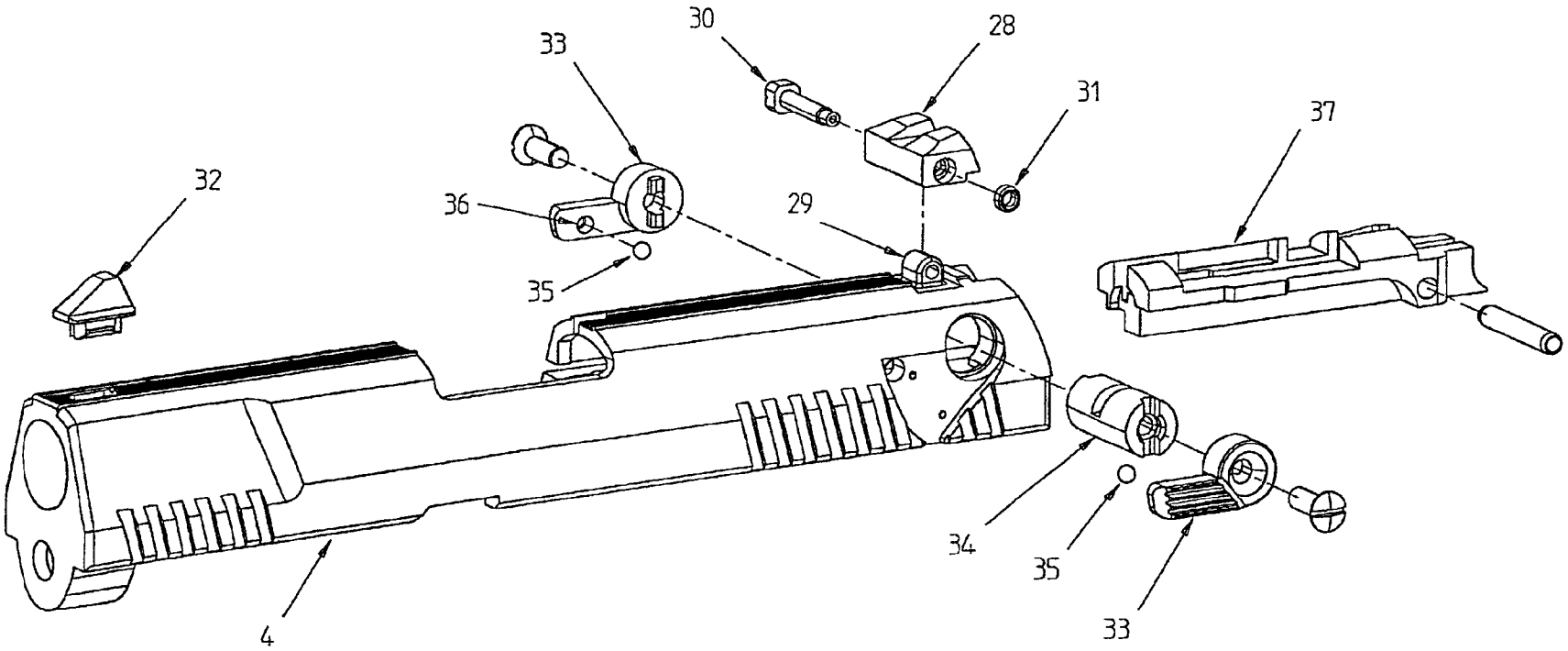
FIG. 7 shows an exploded view of the bolt of a firearm as claimed in the invention with the parts attached thereto.

FIG. 7 shows the attachment of the rear sight 28 on the bolt 4. A rear sight mounting 29 is attached to the rear top of the bolt 4 and corresponds essentially to a cylinder section, which, with its cut surface, rests on the top of the rear sight 28. Furthermore, the rear sight mounting 29 in the transverse direction has an inside thread.

Accordingly, the rear sight 28 in the transverse direction, has a through hole, and the rear sight 28 can be placed on the rear sight mounting 29 such that the hole of the rear sight 28 is flush with the inside thread of the rear sight mounting 29. Furthermore, on the top of the rear sight 28, there is a recess for inserting the rear sight mounting. Furthermore, there is a setscrew 30, which, when the rear sight 28 has been slipped onto the rear sight mounting 29, can be screwed through the hole in the rear sight 28 into the inside thread of the rear sight mounting This is indicated in the exploded drawing in FIG. 7. A retaining disk 31 can be slipped onto the end of the setscrew 30 which projects on the opposite end out of the hole of the rear sight 28 and riveted.

By turning the setscrew 30, the rear sight 28 can be adjusted in the transverse direction relative to the rear sight mounting 29 and thus relative to the bolt 4, and the front sight 32 which is attached to the bolt 4. To do this, the recess, in the rear sight 28 for holding the rear sight mounting 29 in the transverse direction, is larger than the rear sight mounting 29. In particular, in the hole in the rear sight 28, a catch projection is mounted to ensure that the setscrew 30 can be turned with catching.

FIG. 7 shows two safety fins 33, which together with a cylinder-shaped roller safety 34, which can be pushed through the bolt 4, form a safety unit. As in the existing art, the safety fins 33 can be transferred from a safety-on position, into a safety-off position. Making the safety fins 33 out of plastic is novel. In the recesses 36 on the safety fins 33, balls 35 are inserted which interact with the corresponding recesses on the bolt 4 for catching in the end positions of the safety fins 33. As a result of the elasticity of the plastic safety fins 22, the balls 35 need not be held by wire springs.

Furthermore, FIG. 7 shows a breech block 37 which is made of steel. Conversely, the bolt 4 in which the breech block 37 is installed, is produced from a zinc diecasting, an aluminum, a plastic, or the like. Thus, an especially stressed part, such as the breech block 37, is produced from a correspondingly wear-proof material like steel. Conversely the bolt 4 is made from a relatively light and economical material.

Figure 9:
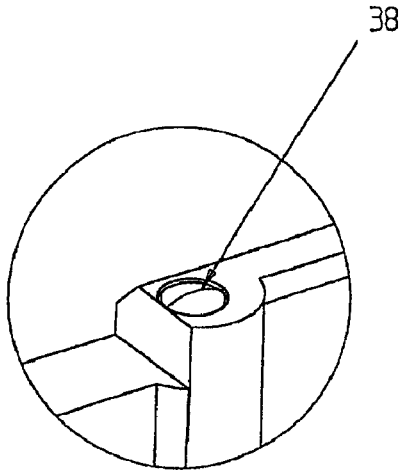
FIG. 9 shows a detailed view according to the arrow IX in FIG. 8.
Figure 8:
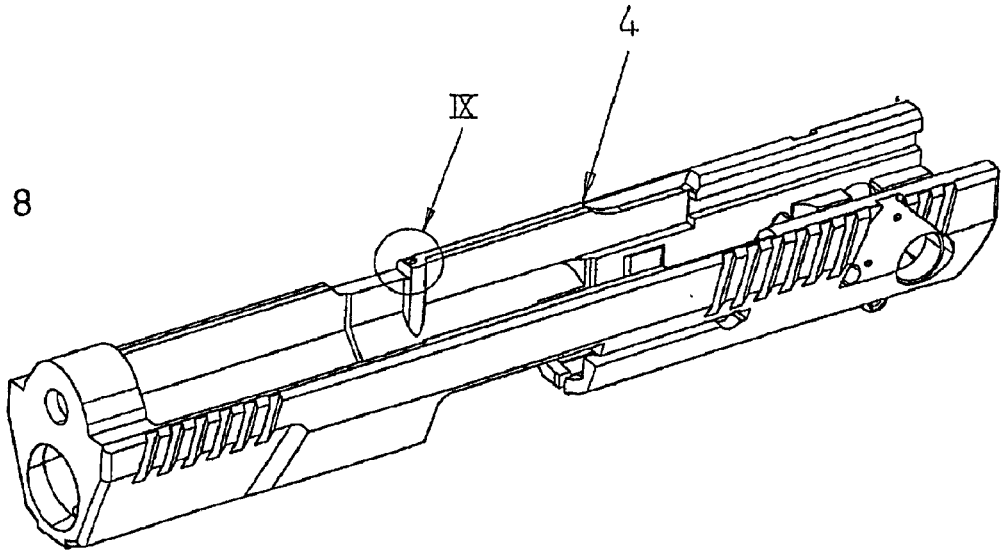
FIG. 8 shows a perspective view from underneath the bolt.

A similar consideration leads to the cylinder pin 38 shown in FIG. 8 and FIG. 9 being made of steel. This cylinder pin 38 is used as wear protection for the slide catch lever which is not shown. In turn, an especially stressed part is made from a resistant material. Conversely, the bolt 4 is made from a zinc diecasting, an aluminum or a plastic.

Figure 4:
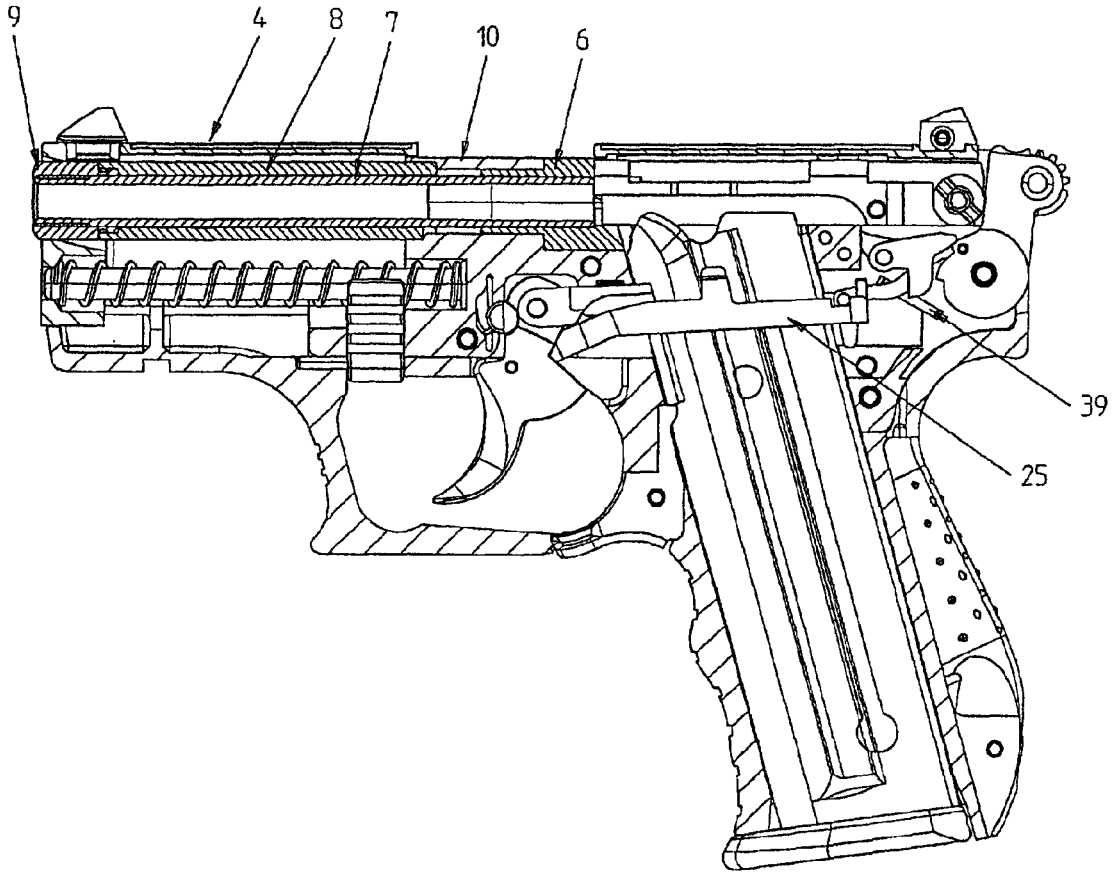
FIG. 4 shows a partially cutaway side view corresponding to FIG. 3.

Similarly, the cylinder pin 39 shown in FIG. 1 and FIG. 4 is made of steel. Conversely, the frame part 2*b* and the frame part 2*a*, are made from a zinc diecasting, an aluminum or a plastic. In turn, one of the main wearing parts, specifically the cylinder pin 39, which interacts with the connecting rod 25, is produced from a wearproof material. Conversely, the other components, with a large volume, are produced from a light, economical material, such as, for example, a zinc diecasting.

Figure 10:
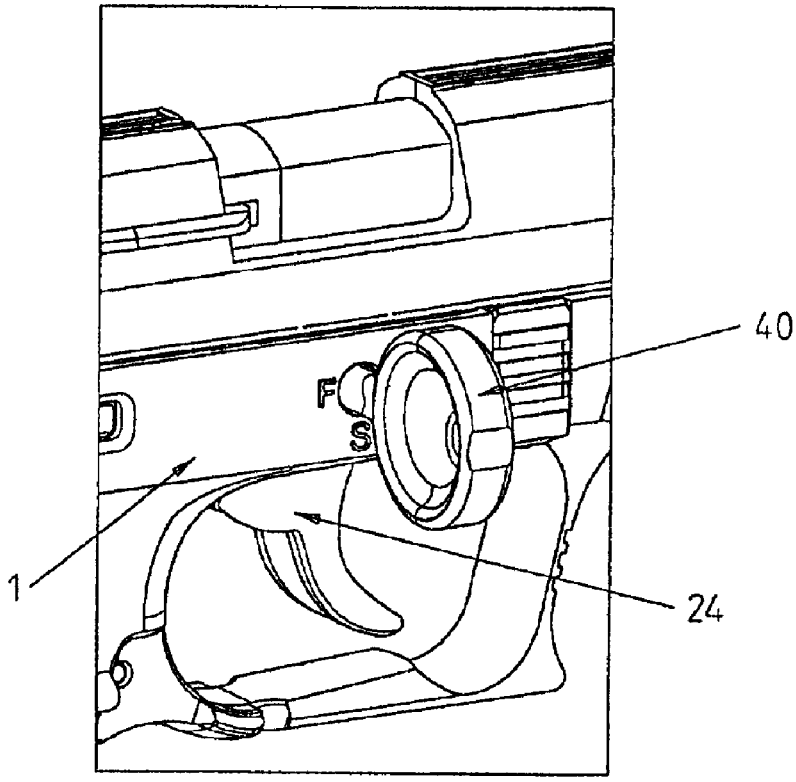
FIG. 10 shows a detailed perspective of the trigger lock of a firearm as claimed in the invention.
Figure 11:
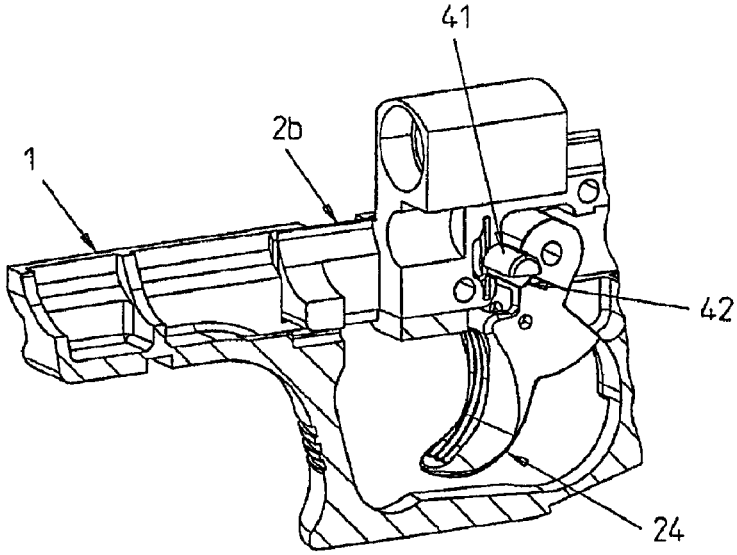
FIG. 11 shows a partially cutaway view of the right-hand frame part with the trigger attached thereto.
Figure 12:
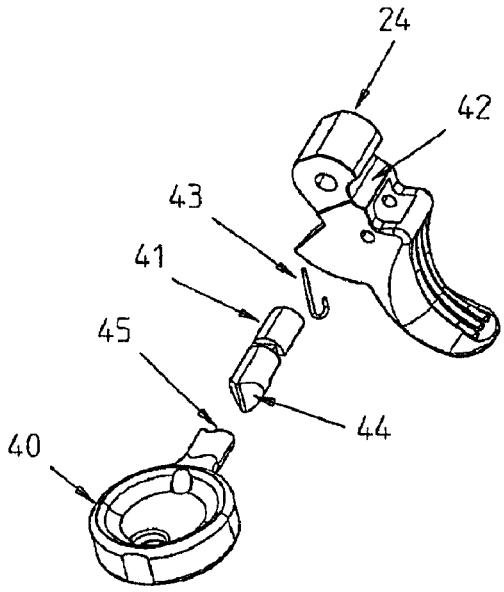
FIG. 12 shows an exploded view of the parts which interact with the trigger lock.

In FIG. 10, the trigger lock unit can be removed with a wrench 40 which can extend through the opening in the grip 1 to the trigger lock 41 shown in FIG. 11 and FIG. 12. By means of the wrench 40, the trigger lock 41 can be moved out of the position in which the trigger can be actuated into the position in which it cannot be actuated. In particular, FIG. 11 and FIG. 12 show that the trigger lock 41 is made essentially as a half-cylinder, which, in the blocked position, can fit into a corresponding semicylindrical receiver 42 on the trigger 24. The trigger lock 41 is locked here by means of a spring 43 on the frame part 2*b*. Furthermore, the trigger lock 41 on its side facing the opening, in the grip part 1, has a roof-like surface 44 which cannot be gripped and turned from the outside with tools like screwdrivers, or the like. The wrench 40 on its end which can be inserted into the grip part 1, has a correspondingly shaped opposing contour 45. The trigger lock 41 can only be turned by the wrench 40, particularly by the roof-like surface 44, and the corresponding opposing contour 45, when the wrench is pressed with a certain force into the opening on the grip part 1. This offers additional safety.

Figure 13A:
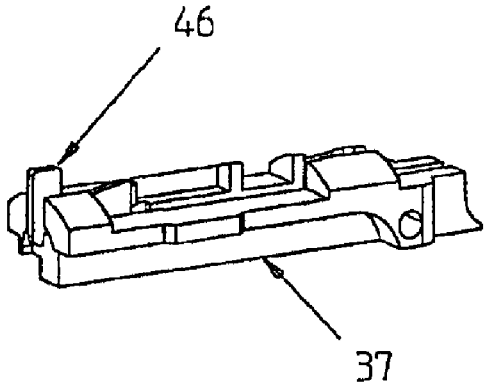
FIG. 13*a* shows a perspective view of a breech block with the loaded state indication.
Figure 13B:
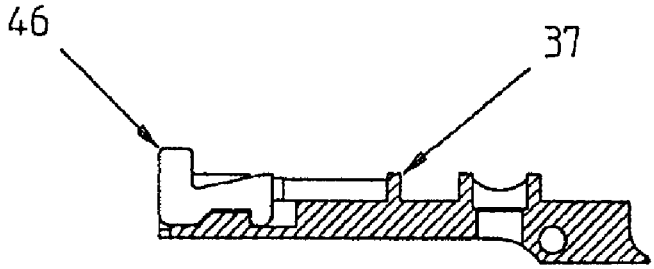
FIG. 13*b* is a cutaway of the breech block with the loaded state display.

FIG. 13*a* and FIG. 13*b* show that on the breech block 37, a loaded state indicator 46 is pivotally mounted which when there is a round in the barrel indicates to the user that the firearm is loaded. The loaded state indicator 46 is made of plastic and when the firearm is loaded adjoins the rear edge of the cartridge.

Figure 3:
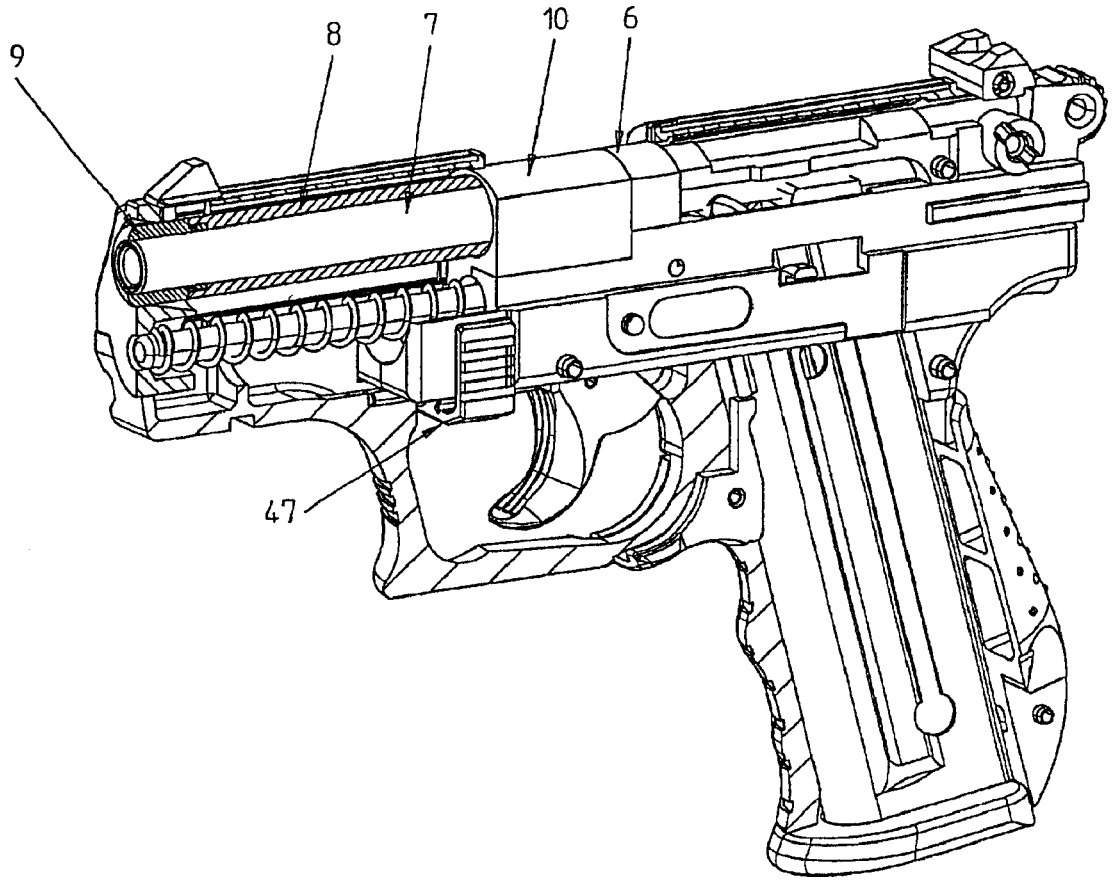
FIG. 3 shows a perspective partially cutaway view of the firearm as claimed in the invention with the barrel unit and bolt mounted.
Figure 14:
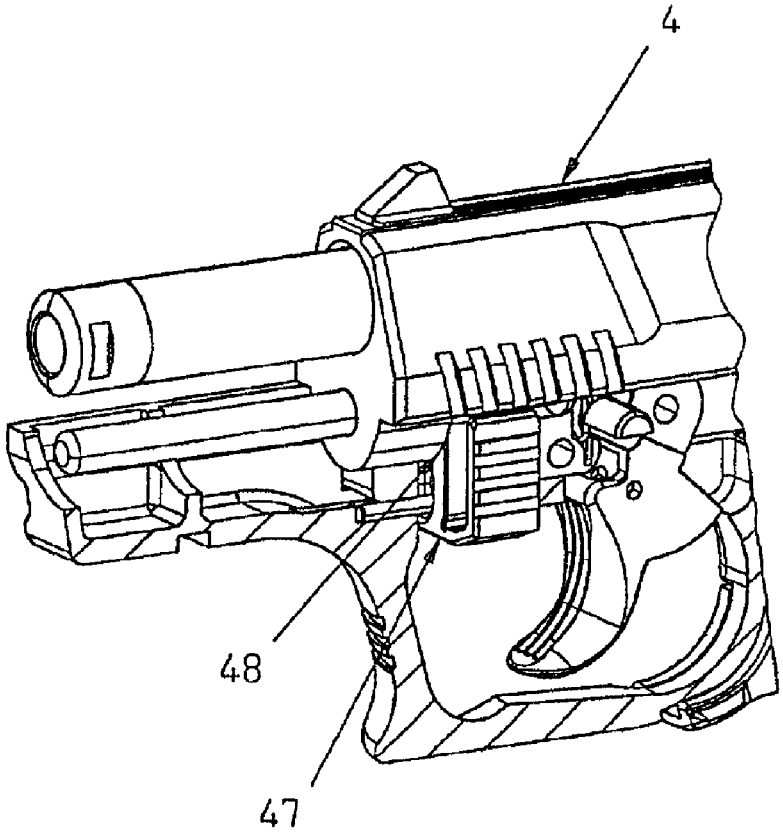
FIG. 14 shows a partially cutaway detailed view of a firearm as claimed in the invention with a dismounting clip.

FIG. 3 and FIG. 14 show a dismounting clip 47 which in the firearm, as in weapons from the existing art, is used to movably hold the bolt on the frame part 2 in the upper position and to release the bolt for removal in the lower position. In the embodiment shown, the dismounting clip 47 is used at the same time as an end stop for the corresponding contact surface 48 of the bolt 4 when the bolt 4 moves to the rear when a round is fired. In the embodiment shown, the dismounting lever 47 is made from, at least partially, an elastic plastic so that a buffer effect is achieved by the contact surface 48 meeting the dismantling clip 47.

What is claimed is:

1. A fire arm comprising a grip, a frame connected to the grip, a bolt that can move relative to the frame and a barrel unit, such that, when a shot is fired, the bolt can move to the rear against a direction of firing, the barrel unit fixed on the frame in an operating state of the fire arm, wherein the barrel unit comprises a barrel tube, a barrel block which is mounted on an end of the barrel tube which is a back end in the direction of firing, a frame bridge which allow detachable mounting of the barrel unit on the frame and which has a through hole in which the barrel tube can be inserted and through which the barrel tube extends when the barrel unit has been mounted on the frame, wherein the barrel block fits from the rear on the frame bridge.

2. The fire arm as claimed in claim 1, wherein on the barrel block there is a rise for inserting a round into the barrel tube and an extractor groove for pulling out an empty shell casing.

3. The fire arm as claimed in claim 1, wherein on a bottom of the barrel block, a guide rib is attached, which fits into a guide groove which interacts with it on the frame, when the barrel unit has been mounted on the frame.

4. The fire arm as claimed in claim 1, wherein the fastening means comprise screw means by which the barrel unit can be fixed on the frame when they are joined to one another.

5. The fire arm as claimed in claim 4, wherein the screw means comprise a barrel nut which is encompassed by the barrel unit and an outside thread in an end area of the barrel tube which is a forward area in the direction of firing, and by screwing the barrel nut onto the outside thread of the barrel tube the barrel unit can be fixed on the frame bridge.

6. The fire arm as claimed in claim 5, wherein the barrel unit further comprises a barrel jacket which is slipped onto the barrel tube from a front such that with a forward end it can adjoin the barrel nut and wherein at the same time the barrel nut can be screwed onto an outside thread of the barrel tube.

7. The fire arm as claimed in claim 6, wherein when the barrel unit is mounted on the frame, the barrel jacket from forward fits on the frame bridge, and the barrel block from a rear, fits on the frame bridge so that when the barrel nut is tightened, the barrel jacket and the barrel block are pressed from the front or back against a corresponding contact surface of the frame bridge so that the barrel unit is securely fixed on the frame.

8. The fire arm as claimed in claim 1, wherein the bolt is made as an unlocked bolt.

9. The fire arm as claimed in claim 1, wherein the frame comprises two frame parts with the same structure, a frame bridge is attached to one of the frame parts.

10. The fire arm as claimed in claim 1, wherein the fire arm further comprises a magazine safety which allows a round to be fired only when a magazine tube has been pushed into the fire arm, when the magazine tube has not been pushed in, the magazine safety pivotally supported on the frame is pressed by a spring against a connecting rod which connects a trigger to a sear which is dynamically connected to a hammer, the connecting rod in the state pressed down cannot fire a round, and the magazine tube inserted the magazine safety is pressed up against the force of the spring such that the connecting rod moves up into a position such that by actuating the trigger a shot can be fired.

11. The fire arm as claimed in claim 1, wherein the firearm further comprises a trigger lock that is transferred out of the position in which the trigger can be actuated into a position in which the trigger cannot be actuated, the trigger lock having an engagement surface which is made as a roof-like surface, the engagement surface is reached through an opening in the grip from an outside, and a wrench is provided which has an opposing contour which corresponds to the engagement surface.

12. The fire arm as claimed in claim 1, wherein the fire arm has a rear sight which can be adjusted in a transverse direction, and which by means of a rear sight mounting is attached on a rear top of the bolt, the rear sight mounting having an internal thread which extends in a transverse direction and the rear sight having a through hole which extends in the transverse direction, and after placing the rear sight on the sight mounting such that the hole of the rear sight is flush with an internal thread of the sight mounting, a setscrew can be inserted through a hole of the rear sight into the internal thread of the rear sight mounting such that by turning the setscrew the rear sight is adjusted relative to the bolt in the transverse direction.

13. The fire arm as claimed in claim 1, wherein the fire arm, in a rear area of the bolt, has a roller safety with safety fins which are attached thereto on an outside and which can be shifted by catching from a safety-on into a safety-off position of the roller safety, the safety fins are made of a flexible material wherein locking in two end positions is achieved by catch cams in the form of balls mounted accordingly on the safety fins in an area of the end positions.

14. The fire arm as claimed in claim 1, wherein the fire arm has a breech block which is housed in the bolt and which is made of steel, the bolt is a zinc diecasting, an aluminum, or a plastic.

15. The fire arm as claimed in claim 1, wherein the bolt is made from a zinc casting, an aluminum or a plastic, and wherein a steel cylinder pin is inserted into a side wall of the bolt and is used as wear protection for a slide catch lever.

16. The fire arm as claimed in claim 1, wherein the frame is made from a zinc diecasting, an aluminum or plastic, and the fire arm further comprises a cylinder pin which interacts with a connecting rod and which is located on the frame.

17. The fire arm as claimed in claim 1, wherein the fire arm further comprises a dismounting clip which is movably held on the frame and in an upper position releases the bolt on the frame to be able to move and in a lower position releases the bolt for removal, the dismounting clip is made of an at least partially elastic material, the dismounting clip is an end stop for a corresponding contact surface of the bolt when the bolt moves to a rear when a round is fired.

18. The firearm of claim 1, further comprising a barrel jacket in telescoping relation to said barrel tube, said barrel jacket abutting said frame bridge front face.

19. The firearm of claim 1, further comprising a barrel nut fastened to said barrel tube.

20. The firearm of claim 1, further comprising a bolt which can move relative to said frame.

* * * * *